US009157448B2

(12) United States Patent
Smith et al.

(10) Patent No.: US 9,157,448 B2
(45) Date of Patent: Oct. 13, 2015

(54) TURBULENCE MEMBER, SYSTEM AND FLUID HANDLING DEVICE FOR PROTECTING A SEAL ASSEMBLY

(75) Inventors: Jeremy William Smith, Grove City, PA (US); William Edward Gray, Grove City, PA (US)

(73) Assignee: General Electric Company, Schenectady, NY (US)

( * ) Notice: Subject to any disclaimer, the term of this patent is extended or adjusted under 35 U.S.C. 154(b) by 784 days.

(21) Appl. No.: 13/438,610

(22) Filed: Apr. 3, 2012

(65) Prior Publication Data

US 2013/0255804 A1 Oct. 3, 2013

(51) Int. Cl.
*F04D 29/12* (2006.01)

(52) U.S. Cl.
CPC ..... *F04D 29/126* (2013.01); *Y10T 137/8593* (2015.04); *Y10T 137/85978* (2015.04)

(58) Field of Classification Search
USPC ..... 415/111, 113, 170.1, 206
See application file for complete search history.

(56) References Cited

U.S. PATENT DOCUMENTS

| | | | | |
|---|---|---|---|---|
| 3,076,412 | A * | 2/1963 | Harker et al. | 415/170.1 |
| 4,812,108 | A * | 3/1989 | Kotera | 417/368 |
| 4,913,620 | A | 4/1990 | Kusiak et al. | |
| 4,940,385 | A * | 7/1990 | Gurth | 415/206 |
| 5,163,821 | A | 11/1992 | Kelly et al. | |
| 5,195,867 | A * | 3/1993 | Stirling | 415/111 |
| 5,217,350 | A | 6/1993 | Kimura et al. | |
| 5,226,790 | A | 7/1993 | Serafin | |
| 5,257,901 | A | 11/1993 | Malchow | |
| 5,336,047 | A | 8/1994 | Kolhouse | |
| 5,413,462 | A | 5/1995 | Alberni | |
| 5,489,187 | A * | 2/1996 | Ray | 415/111 |
| 5,871,332 | A | 2/1999 | Gray et al. | |
| 5,937,830 | A | 8/1999 | Tigerholm | |
| 5,984,743 | A | 11/1999 | Wada et al. | |
| 6,112,706 | A | 9/2000 | Heer | |
| 6,135,064 | A | 10/2000 | Logan et al. | |
| 6,135,066 | A | 10/2000 | Matsuto et al. | |
| 2007/0217907 | A1 | 9/2007 | Slike et al. | |
| 2011/0250059 | A1 | 10/2011 | Reischmann et al. | |

FOREIGN PATENT DOCUMENTS

JP 55151196 A 11/1980

OTHER PUBLICATIONS

International Search Report and Written Opinion issued in connection with corresponding PCT Application No. PCT/US2013/027204 dated Nov. 29, 2013.

* cited by examiner

*Primary Examiner* — Edward Look
*Assistant Examiner* — Aaron R Eastman
(74) *Attorney, Agent, or Firm* — GE Global Patent Operation

(57) ABSTRACT

Various systems and apparatuses are provided for a turbulence member for an annular seal cavity in a fluid handling device. In one example, the turbulence member includes an inner face positioned to cooperate with a seal assembly in the annular seal cavity to define an inner channel. The turbulence member also includes an outer face positioned to cooperate with a housing to define an outer channel in the annular seal cavity. The turbulence member also includes a front face extending between the inner face and the outer face, and a rear face spaced from the front face and extending between the inner face and the outer face. The turbulence member is configured to disrupt fluid flow within the annular seal cavity and inhibit formation of an air pocket adjacent to the seal assembly.

19 Claims, 11 Drawing Sheets

TURBULENCE MEMBER, SYSTEM AND FLUID HANDLING DEVICE FOR PROTECTING A SEAL ASSEMBLY

FIELD

Embodiments of the subject matter disclosed herein relate to fluid handling devices. Other embodiments relate to turbulence members and seal protection systems for fluid handling devices.

BACKGROUND

Fluid handling devices, such as centrifugal pumps, may be used in a variety of applications to move fluid through a system. A centrifugal pump includes a rotating impeller that receives a fluid flow along its rotating axis, and accelerates or pushes the fluid radially outward through an outlet. In certain centrifugal pumps, a mechanical seal is utilized in the location where the rotating shaft that carries the impeller passes through a stationary housing. In some examples, the mechanical seal may be located in a seal cavity defined by the impeller, a portion of the stationary housing, and a gland plate.

In normal operation, a portion of the fluid that is being moved by the centrifugal pump will flow into the seal cavity and contact the mechanical seal. Such fluid may thereby provide lubrication and cooling to the mechanical seal. However, in some cases the centrifugal forces generated by the impeller in the seal cavity may pull fluid away from the mechanical seal, and one or more air pockets may form adjacent to the mechanical seal. The formation of such air pockets can increase local friction and temperatures of the mechanical seal components, thereby causing accelerated wear of such components and correspondingly reducing the useful life of the seal. Such increased heat may also affect other regions of the pump such as, for example, causing compression set in elastomeric O-rings leading to leaks and failures in adjacent areas.

BRIEF DESCRIPTION OF THE INVENTION

In one embodiment, a turbulence member for an annular seal cavity in a fluid handling device is provided. The turbulence member includes an inner face positioned to cooperate with a seal assembly in the annular seal cavity to define an inner channel between the inner face and the seal assembly. The turbulence member includes an outer face that is positioned to cooperate with a housing to define an outer channel in the annular seal cavity. The turbulence member also includes a front face extending between the inner face and the outer face, and a rear face spaced from the front face and extending between the inner face and the outer face.

In one embodiment, the turbulence member disrupts fluid flow within the annular seal cavity to inhibit formation of an air pocket adjacent to the seal assembly. The turbulence member may be removably coupled to a gland plate, thereby enabling convenient removal and/or adjustment of the position of the turbulence member. In some examples, the inner channel of the turbulence member may have an inner channel variable depth, and the outer channel of the turbulence member may have an outer channel variable depth. In this manner, improved flow disruption activity may be created. In other examples, two or more turbulence members may be provided in the annular seal cavity. Advantageously, providing two or more turbulence members may enable desired flow disruption characteristics for a particular seal assembly.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

The following description relates to various embodiments of seal protection systems for a seal assembly in a fluid handling device, the seal protection systems including one or more turbulence members located in an annular seal cavity. In some embodiments, the seal protection systems and turbulence members are configured for a water pump in an engine-cooling system of an internal combustion engine in a vehicle, such as a rail vehicle. In other embodiments, the seal protection systems and turbulence members may be configured for other fluid handling devices and for use with other engines and/or vehicles.

Figure 1:
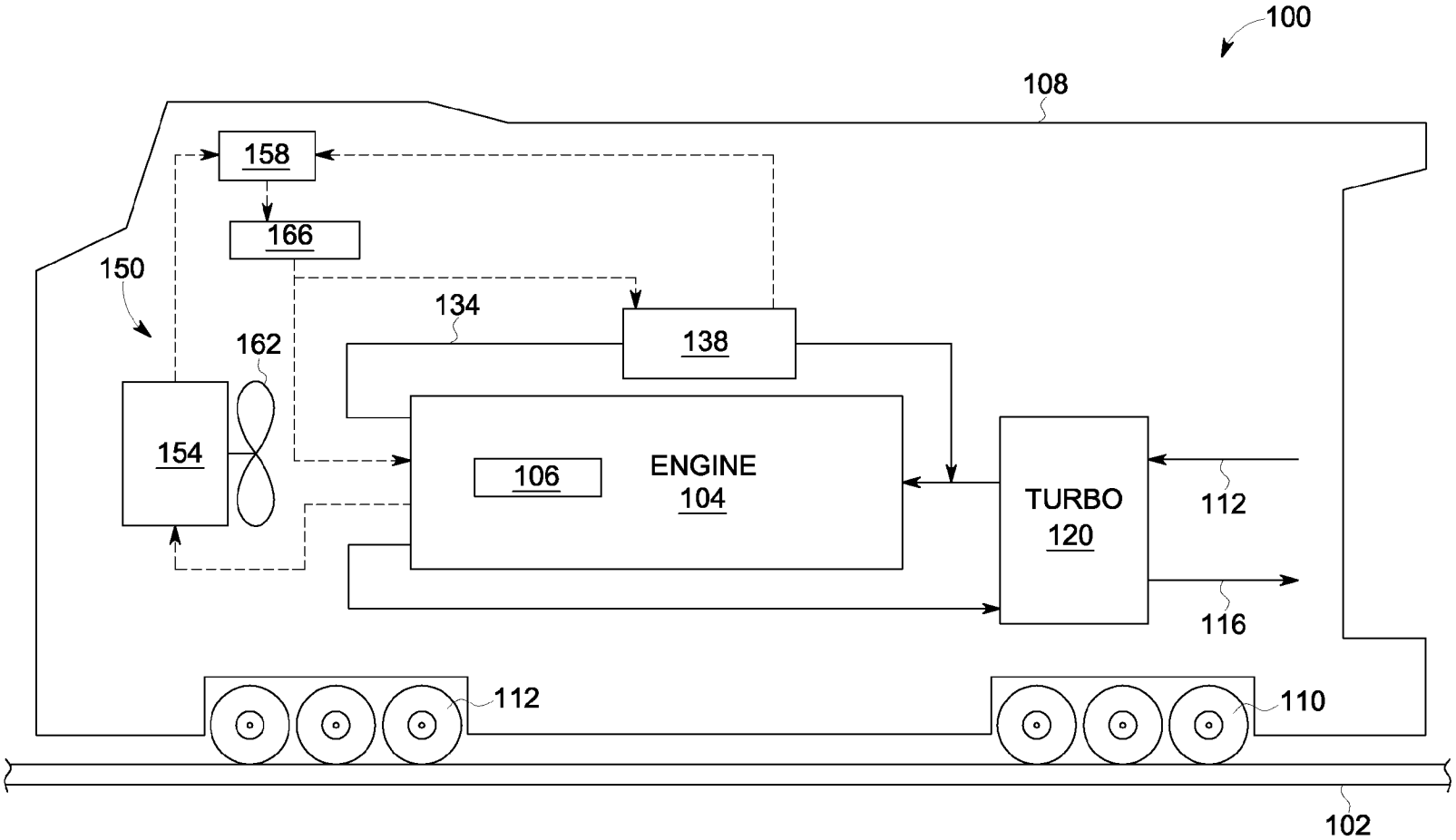
FIG. 1 shows a schematic diagram of an embodiment of a rail vehicle with a fluid handling device and a seal protection system and associated turbulence member according to an embodiment of the invention.
Figure 2:
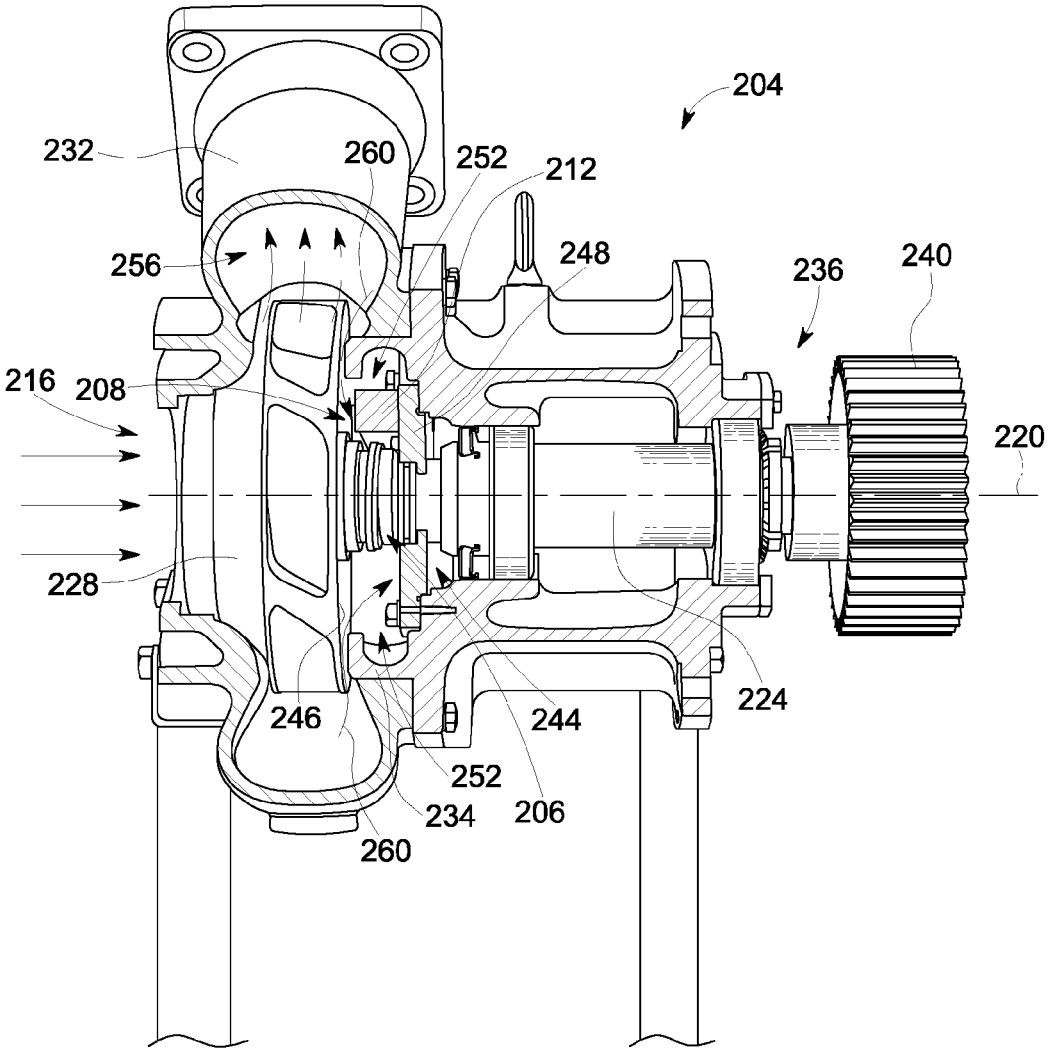
FIG. 2 shows a cut away view, approximately to scale, of an embodiment of a centrifugal pump including a seal protection system and associated turbulence member according to an embodiment of the invention.
Figure 3:
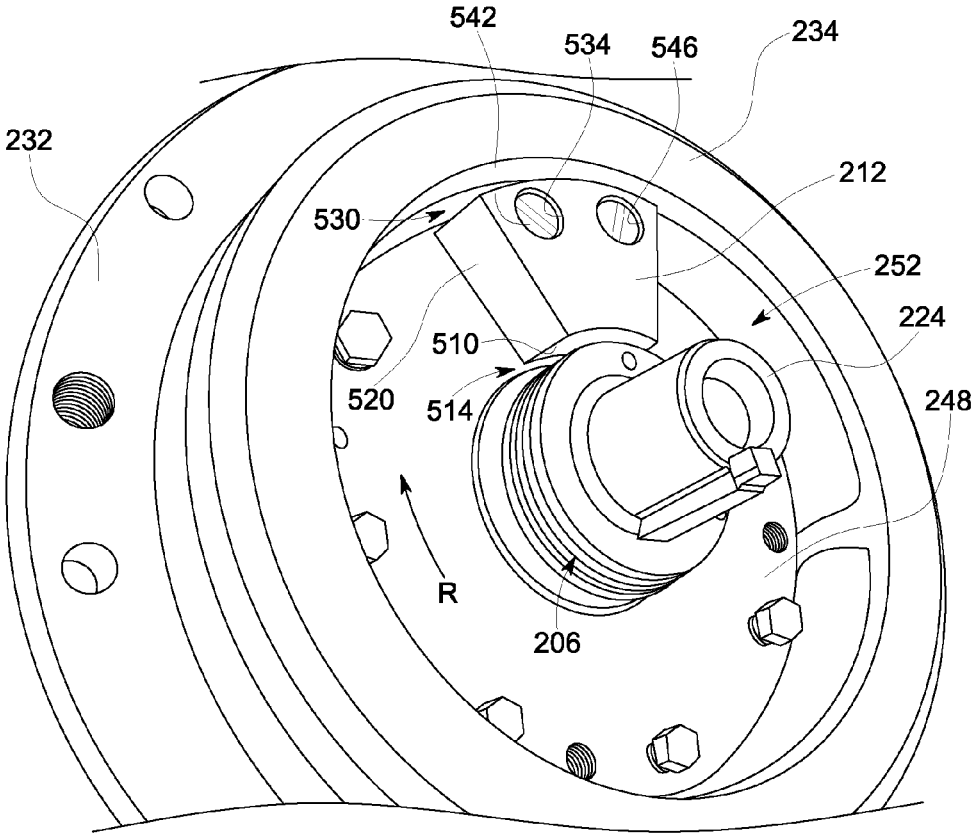
FIG. 3 shows a perspective view, approximately to scale, of a portion of the centrifugal pump of FIG. 2 showing an embodiment of the turbulence member installed on a gland plate.

FIG. 1 shows a schematic diagram of an example rail vehicle in which the seal protection systems and turbulence members may be utilized. FIG. 2 shows a cut away view of an embodiment of a centrifugal pump that includes a seal protection system and associated turbulence member according to an embodiment of the invention. FIG. 3 shows a perspective view of a portion of the centrifugal pump of FIG. 2 in which an embodiment of a turbulence member is installed on a gland plate of the pump.

Figure 4:
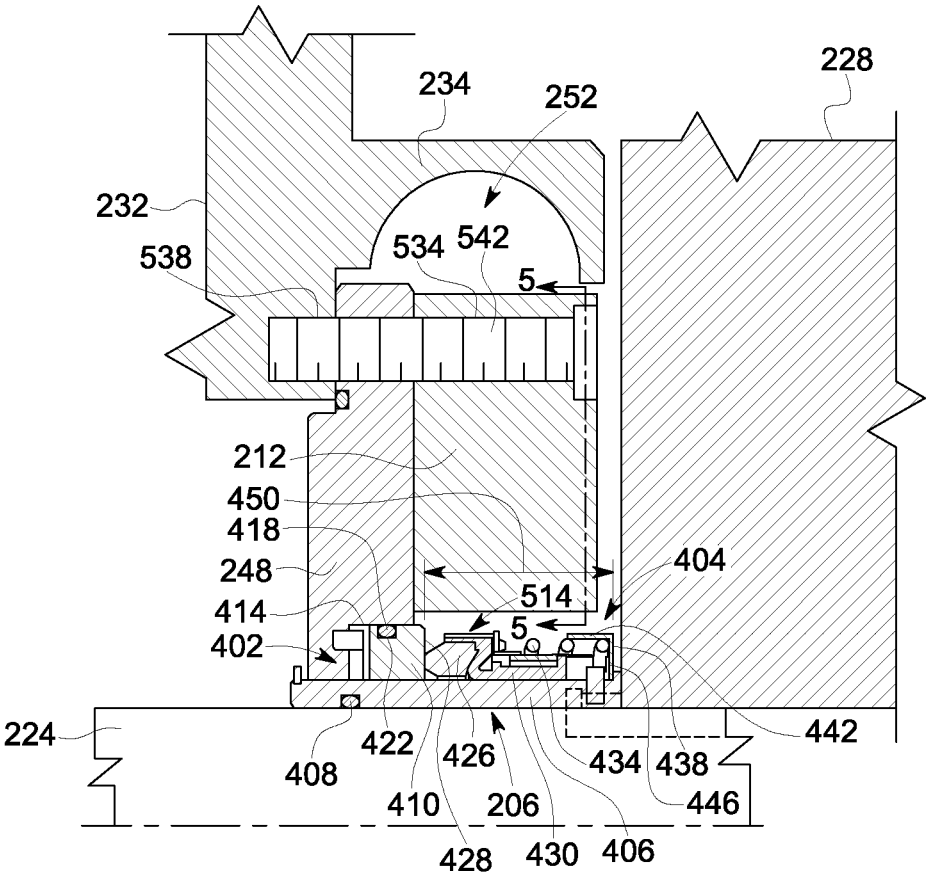
FIG. 4 shows a detailed cut away view, approximately to scale, of a portion of the centrifugal pump of FIG. 2 showing an embodiment of the turbulence member located within an annular seal cavity.
Figure 5:
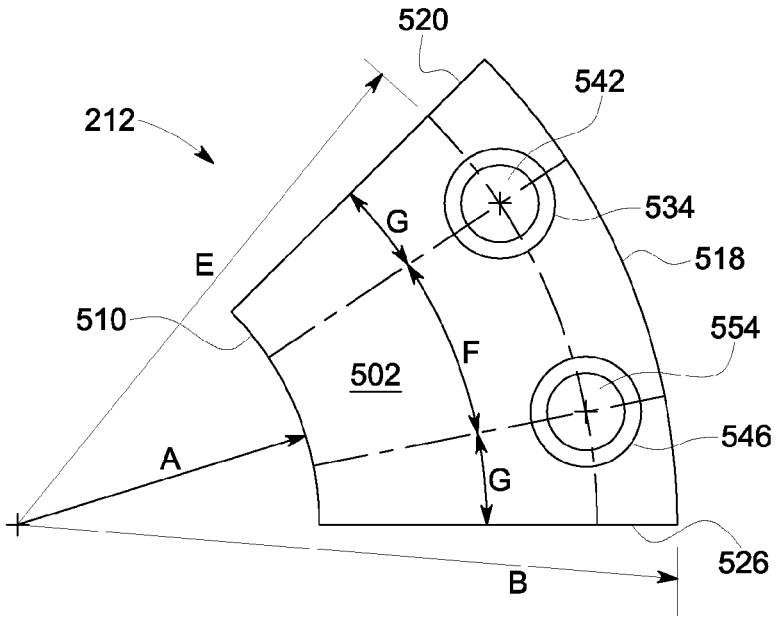
FIG. 5 shows a cross-sectional view the turbulence member of FIG. 4 taken along line 5-5 of FIG. 4.
Figure 6:
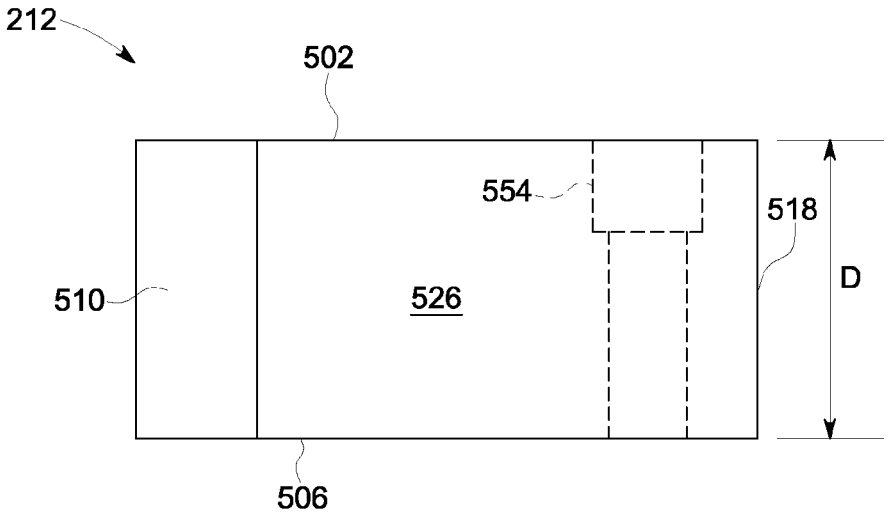
FIG. 6 shows a side view of the turbulence member shown in FIG. 5.
Figure 7:
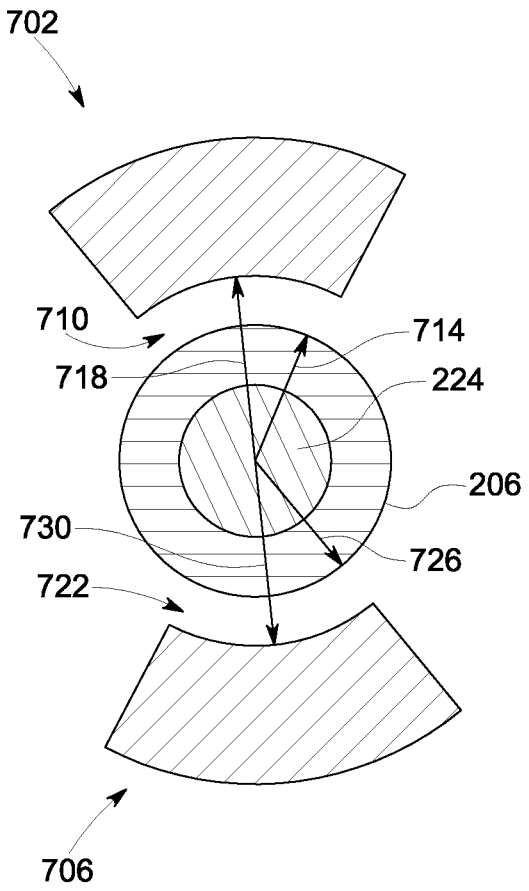
FIG. 7 shows a partial cut away view of an embodiment showing two turbulence members located on opposing sides of a seal assembly.

FIG. 4 shows a detailed cut away view, approximately to scale, of a portion of the centrifugal pump of FIG. 2 showing an embodiment of a turbulence member located within an annular seal cavity. FIG. 5 shows a cross-sectional view the turbulence member of FIG. 4 taken along line 5-5 of FIG. 4. FIG. 6 shows a side view of the turbulence member shown in FIG. 5. FIG. 7 shows a partial cut away view of another embodiment showing two turbulence members located on opposite sides of a seal assembly. FIGS. 8-16 show perspective views of other embodiments of one or more turbulence members installed on a gland plate of a fluid handling device.

It will be appreciated that the approaches described herein may be employed in a variety of fluid handling device types, which may be used in a variety of applications. In some examples, the approaches described herein may be used in centrifugal pumps that may be used in cooling systems of a variety of engine types, and with a variety of engine-driven systems. Some of these engine systems may be stationary while others may be on semi-mobile or mobile platforms. In some examples, semi-mobile platforms may be relocated between operational periods, such as mounted on flatbed trailers. In other examples, mobile platforms may include self-propelled vehicles. Such vehicles can include, for example, mining equipment, marine vessels, on-road transportation vehicles, off-highway vehicles (OHV), and rail vehicles. For clarity of illustration, a locomotive is provided as an example mobile platform supporting a system incorporating an embodiment of the invention.

Before further discussion of the approaches described herein, an example of a platform is disclosed in which the seal protection systems and turbulence members may be configured for an engine in a vehicle, such as a rail vehicle. FIG. 1 shows a block diagram of an embodiment of a vehicle system 100 (e.g., a locomotive system), herein depicted as a rail vehicle 108, configured to run on a rail 102 via a plurality of wheels 110. As depicted, the rail vehicle 108 includes an engine 104, such as an internal combustion engine. In other non-limiting embodiments, the engine 104 may be a stationary engine, such as in a power-plant application, or an engine in a marine vessel or other off-highway vehicle propulsion system as noted above.

The vehicle system 100 includes an engine cooling system 150. The engine cooling system 150 includes a tank 158 that may hold coolant, such as water. A pump 166, such as a centrifugal pump, circulates the coolant through the engine 104 to absorb waste engine heat and distribute the heated coolant to a heat exchanger, such as a radiator 154. In one example, the pump 166 is geared to and driven by the crankshaft 106 of the engine 104. In this example, the pump 166 may be a variable speed pump that operates at different speeds according to a rotational speed of the crankshaft 106.

A fan 162 may be coupled to the radiator 154 in order to maintain an airflow through the radiator while the engine 104 is running and the vehicle 108 is moving slowly or stopped. In some examples, fan speed may be controlled by a controller (not shown). Coolant which is cooled by the radiator 152 enters the tank 158. The coolant may then be pumped by the pump 166 back to the engine 104 or to another component of the vehicle system, such as an exhaust gas recirculation (EGR) cooler 138.

As depicted in FIG. 1, the engine 104 may receive intake air for combustion from an intake passage 112. The intake passage 112 receives ambient air from an air filter (not shown) that filters air from outside of the rail vehicle 108. Exhaust gas resulting from combustion in the engine 104 may be supplied to an exhaust passage 116. Exhaust gas flows through the exhaust passage 116 and out of an exhaust stack (not shown) of the rail vehicle 108. A portion of the exhaust gas may also flow through an EGR passage 134 and into the EGR cooler 138, where it is cooled and returned to the intake passage 112.

The vehicle system 100 may also include a turbocharger 120 that is arranged between the intake passage 112 and the exhaust passage 116. The turbocharger 120 increases air charge of ambient air drawn into the intake passage 112 in order to provide greater charge density during combustion to increase power output and/or engine-operating efficiency. The turbocharger 120 may include a compressor (not shown) which is at least partially driven by a turbine (not shown).

In one example, the engine 104 is a diesel engine that combusts air and diesel fuel through compression ignition. In other non-limiting embodiments, the engine 104 may combust fuel including gasoline, kerosene, biodiesel, or other petroleum distillates of similar density through compression ignition (and/or spark ignition).

The rail vehicle 108 may further include a controller (not shown) to control various components related to the engine 104. In one example, the controller includes a computer control system. The controller may further include computer readable storage media including code for enabling on-board monitoring and control of rail vehicle operation. The controller, while overseeing control and management of the engine 104, may be configured to receive signals from a variety of engine sensors in order to determine operating parameters and operating conditions, and correspondingly adjust various engine actuators to control operation of the rail vehicle 108. For example, the controller 148 may receive signals from various engine sensors including, but not limited to, engine speed, engine load, coolant temperature, boost pressure, exhaust pressure, ambient pressure, exhaust temperature, etc. Correspondingly, the controller may control the engine 104 by sending commands to various components such as radiator 154, pump 166, traction motors, alternator, cylinder valves, throttle, etc.

Turning to FIG. 2, a cut away view of a centrifugal pump 204 including a seal assembly 206 and a seal protection system 208 and associated turbulence member 212 according to an embodiment of the invention is provided. FIG. 2 is approximately to scale. As depicted in FIG. 2, fluid enters an inlet 216 of the pump 204 generally in an axial direction along a central axis 220. A shaft 224 is rotatably disposed downstream from the inlet and parallel to and coaxial with the central axis 220. A rotatable member, such as an impeller 228, is coupled to the shaft 224 and rotatably disposed within a housing 232 of the pump 204. As described in more detail below, the housing 232 includes an annular seal portion 234 in generally surrounding relationship to the seal assembly 206 and seal protection system 208.

As shown in FIG. 2, the shaft 224 includes a driven end 236 that is coupled to a gear 240. In one example, the gear 240 is driven by a crankshaft of an engine, such as crankshaft 106 of engine 104 as described above with reference to FIG. 1. It will be appreciated that the gear 240 may be driven in any suitable manner, such as via a belt, powered gear, etc. A driving end 244 of the shaft 224 is located opposite to the driven end 236. The driving end 244 of the shaft 224 extends through a gland plate 248 and through the seal assembly 206, and is coupled to the impeller 228 to rotate the impeller.

As described in more detail below, the seal protection system 208 includes the gland plate 248 that is in surrounding relationship to the shaft 224. The seal assembly 206 includes a first end that is adjacent to the gland plate 248 and is also in surrounding relationship to the shaft 224. The seal assembly 206 also includes a second end that is opposite to the first end and is adjacent to an inner face 246 of the impeller 228. The gland plate 248, inner face 246 of impeller 228, seal assembly 206 and annular seal portion 234 of the housing 232 cooperate to form an annular seal cavity 252.

As gear 240 is driven, the shaft 224 and impeller 228 are rotated. Fluid entering the inlet 216 along central axis 200 is moved radially outward by the rotating impeller 228 through an outlet 256 that is fluidically coupled to the inlet 216. As indicated by arrows 260, a portion of the fluid that is being moved by the impeller 228 will flow behind the impeller and along its inner face 246 into the annular seal cavity 252. Under some operating conditions, the fluid flow 260 may substantially fill the annular seal cavity 252. Under other operating conditions, the fluid flow 260 may only partially fill the annular seal cavity 252. As noted above, such fluid in the annular seal cavity 252 may contact the seal assembly 206 and provide lubrication and cooling to the seal assembly components.

Fluid within the annular seal cavity 252 may also be subjected to centrifugal forces generated by the impeller 228. Such forces may tend to pull fluid away from the seal assembly 206, which can lead to formation of one or more air pockets adjacent to the seal assembly 206. As noted above, such air pockets can increase local friction and temperatures of components of the seal assembly 206, thereby causing accelerated wear of such components and potentially reducing the useful life of the seal assembly 206.

To address the above issues, and with reference now to FIGS. 3-6, in one example the seal protection system 208 includes turbulence member 212 positioned within the annular seal cavity 252. FIG. 3 shows a perspective view, approximately to scale, of the turbulence member 212 shown in FIG. 2 installed on gland plate 248. For ease of illustration, it will be appreciated that FIG. 3 shows the shaft 224 with impeller 228 removed. In one example, during operation of the pump 204 the impeller 228 may rotate in the direction of action arrow R, which correspondingly creates a fluid flow direction within the annular seal cavity 252 in the direction of action arrow R. With reference also to FIG. 4, the turbulence member 212 is mounted on the gland plate 248 between the seal assembly 206 and the annular seal portion 234 of the housing 232. Accordingly, and as described in more detail below, an advantage that may be realized in the practice of some embodiments of the described systems and apparatuses is that the turbulence member disrupts the fluid flow within the annular seal cavity 252 to inhibit formation of an air pocket adjacent to the seal assembly 206.

The seal assembly 206 includes a first end 402 adjacent to the gland plate 248 and a second opposing end 404 adjacent to the impeller 228. As depicted in FIG. 4, in one example the seal assembly 206 may include a sleeve 406 located in surrounding relationship to the shaft 224. An elastomeric sleeve O-ring 408 may be retained in an annular O-ring detent in the sleeve 406. A mating ring 410 encircles the sleeve 406 and is positioned between the sleeve and an axially extending surface 414 of the gland plate 248. An elastomeric mating ring O-ring 418 may be retained in an annular mating ring O-ring detent 422 in the mating ring 410.

With continued reference to FIG. 4, an annular seal member 426 abuts the mating ring 410 and is received by a support member 430. The annular seal member 426 may be urged against a mating face 428 of the mating ring 410 via the support member 430 by a resilient member 434, such as a spring. A retainer part 438 is captured at a distal end of the sleeve 406 and includes an axially extending face 442 that retains a portion of the resilient member 434 between the axially extending face and the sleeve 406. The retainer part 438 further includes an outer face 446 that extends radially from the distal end of the sleeve 406 and defines a working height 450 of the seal assembly 206. In one example, the working height 450 of the seal assembly 206 may be an axial distance between the mating face 428 of the mating ring 410 and the outer face 446 of the retainer part 438. As described in more detail below, in one example the turbulence member 212 may extend axially from the gland plate 248 to a distance that is less than the working height 450 of the seal assembly 206.

With reference now to FIGS. 5 and 6, FIG. 5 shows a cross-sectional view of the turbulence member 212 of FIG. 4 taken along line 5-5 of FIG. 4. FIG. 6 shows a side view of the turbulence member shown in FIG. 5. In this example, the turbulence member 212 may comprise a block having a top surface 502 and an opposing parallel bottom surface 506. An inner face 510 may extend between the top surface 502 and the bottom surface 506 and may have an arcuate profile. In one example, the arcuate profile of the inner face 510 may have a radius of curvature A of approximately 4.29 cm. In other examples, the inner face 510 may have a different radius of curvature according to the configuration and dimensions of a corresponding seal assembly, impeller, and other components of a fluid handling device. With reference also to FIG. 3, the inner face 510 may cooperate with the seal assembly 206 in the annular seal cavity 252 to define an inner channel 514 between the inner face and the seal assembly. As best seen in FIG. 3, in this example the inner channel 514 may have an arcuate profile that substantially corresponds to the arcuate profile of the inner face 510 of the turbulence member 212.

The turbulence member 212 includes an outer face 518 spaced from the inner face 510 and also having an arcuate profile. In one example, the arcuate profile of the outer face 518 may have a radius of curvature B of approximately 9.37 cm. In other examples, the outer face 518 may have a different radius of curvature according to the configuration and dimensions of a corresponding seal assembly, impeller, and other components of a fluid handling device. A front face 520 extends between the inner face 510 and the outer face 518. A rear face 526 is spaced from the front face 520 and also extends between the inner face 510 and the outer face 518. The inner face 510, outer face 518, front face 520 and rear face 526 each extend between the top surface 502 and the bottom surface 506 to define a thickness D of the turbulence member 212. In one example, the thickness D may be approximately 3.0 cm. In other examples, the turbulence member 212 may have a different thickness D according to the configuration and dimensions of a corresponding seal assembly, impeller, and other components of a fluid handling device.

With reference again to FIG. 3, in one example the outer face 518 may cooperate with the annular seal portion 234 of the housing 232 to define an outer channel 530 in the annular seal cavity 252 between the outer face and the annular seal portion of the housing. As best seen in FIG. 3, in this example the outer channel 530 may have an arcuate profile that substantially corresponds to the arcuate profile of the outer face 518 of the turbulence member 212.

In this example, a portion of the fluid flowing within the annular seal cavity 252 in the direction of action arrow R will contact the front face 520 of the turbulence member 212. Other portions of the fluid will be routed around the turbulence member 212 through the inner channel 514 and the outer channel 530 and over the top surface 502 of the turbulence member. Advantageously, with this configuration the turbulence member 212 may disrupt fluid flow within the annular seal cavity 252 to inhibit air pocket formation adjacent to the seal assembly 206, while also enabling a portion of the fluid flow to continuously flow through the inner channel 514 and contact the seal assembly. The flow path provided by the outer channel 530 may also prevent excessive pressure buildup in areas adjacent to the front face 520

With reference again to FIG. 5, the top surface 502 of the turbulence member 212 may define a first area bounded by the inner face 510, outer face 518, front face 520 and rear face 526. A second area corresponding to the annular seal cavity 252 may be defined as an annular area created by sweeping the front face 520 of the turbulence member 212 about radius of curvature A through 360 degrees of the annular seal cavity to create a ring-shaped area. In some examples, the first area defined by the top surface 502 of the turbulence member 212 may be no greater than a percentage of the second, ring-shaped area corresponding to the annular seal cavity 252. In more specific examples, the percentage may be between approximately 5.0% and 20%, and in other examples between approximately 10% and 15%, and in one example approximately 12.5%. In this manner, an advantage that may be realized in the practice of some embodiments is that sufficient circulation of fluid within the annular seal cavity 252 and adjacent to the seal assembly 206 may be maintained, while also providing flow disruption to inhibit formation of one or more air pockets adjacent to the seal assembly 206.

In other non-limiting embodiments, the turbulence member 212 may be removably coupled to the gland plate 248. With reference to FIGS. 3-5, in one example the turbulence member 212 may include a first aperture 534 and the gland plate 248 may include a second aperture 538. A fastener 542 may extend through the first aperture 534 and second aperture 538 to removably couple the turbulence member 212 to the gland plate 248. The turbulence member 212 may also include a third aperture 546 and the gland plate 248 may include a fourth aperture (not shown). A second fastener 554 may extend through the third aperture 546 and fourth aperture to further removably couple the turbulence member 212 to the gland plate 248.

In some examples, the first aperture 534 and the second aperture 546 may be located on a common radius of curvature E. In a more specific non-limiting example, the radius of curvature E may be approximately 8.26 cm. and the first aperture 534 and the second aperture 546 may be spaced from one another along the radius of curvature E by an angle F of approximately 22.5 degrees. In this example, the center of the first aperture 534 may be spaced from the front face 520 along the radius of curvature E by an angle G of approximately 10.0 degrees. Similarly, the center of the second aperture 546 may be spaced from the rear face 526 along the radius of curvature E by an angle G of approximately 10.0 degrees. With respect to this non-limiting example, an advantage that may be realized is improved manufacturability of the turbulence member 212.

Advantageously, by removably coupling the turbulence member 212 to the gland plate 248, the turbulence member may be conveniently removed from the gland plate for repair or maintenance. Additionally, in other non-limiting embodiments, the turbulence member 212 may be removed and replaced with another turbulence member having, for example, a different configuration. It will also be appreciated that in still other non-limiting embodiments, the turbulence member 212 may be welded or otherwise non-removably coupled to the gland plate 248, or mounted to a separate mounting plate that is subsequently mounted to the gland plate. In still other non-limiting embodiments, thin plates welded to the gland plate 248 or baffles welded to a separate mounting plate that is subsequently bolted to the gland plate may also be utilized.

Following now are descriptions of other non-limiting embodiments of one or more turbulence members that may be implemented in conjunction with the seal protection system 208 and centrifugal pump 204 described above and illustrated in FIGS. 1-6. The one or more turbulence members are shown installed on a gland plate, such as gland plate 248, with the other components of the seal protection system 208 and centrifugal pump 204 not shown for clarity. As indicated above, the one or more turbulence members may be removably coupled to the gland plate, welded or otherwise non-removably coupled to the gland plate, or mounted to a separate mounting plate that is subsequently mounted to the gland plate.

With reference now to FIG. 7, in one non-limiting embodiment a first turbulence member 702 and a second turbulence member 706 may be provided on opposing sides of the shaft 224. In one example, both first turbulence member 702 and second turbulence member 706 may have the form and dimensions of the turbulence member 212 described above. In other examples, one or both of the first turbulence member 702 and second turbulence member 706 may have a form and/or dimensions different from the turbulence member 212.

As illustrated in FIG. 7, the first turbulence member 702 may define a first inner channel 710 that has a first inner diameter 714 with respect to the central axis 220 of the shaft 224 (as shown in FIG. 2). The first inner channel 710 may also have a first outer diameter 718 with respect to the central axis 220. In one example, the second turbulence member 706 may define a second inner channel 722 that has a second inner diameter 726 with respect to the central axis 220 of the shaft 224, with the second inner diameter being substantially equal to the first inner diameter 714. The second inner channel 722 may also have a second outer diameter 730 with respect to the central axis 220, with the second outer diameter being substantially equal to the first outer diameter 718. Advantageously, in some examples this configuration of the first turbulence member 702 and the second turbulence member 706 on the gland plate 248 may create enhanced flow disruption within the annular seal cavity 252 to provide improved prevention of air pocket formation adjacent to the seal assembly 206.

Figure 8:
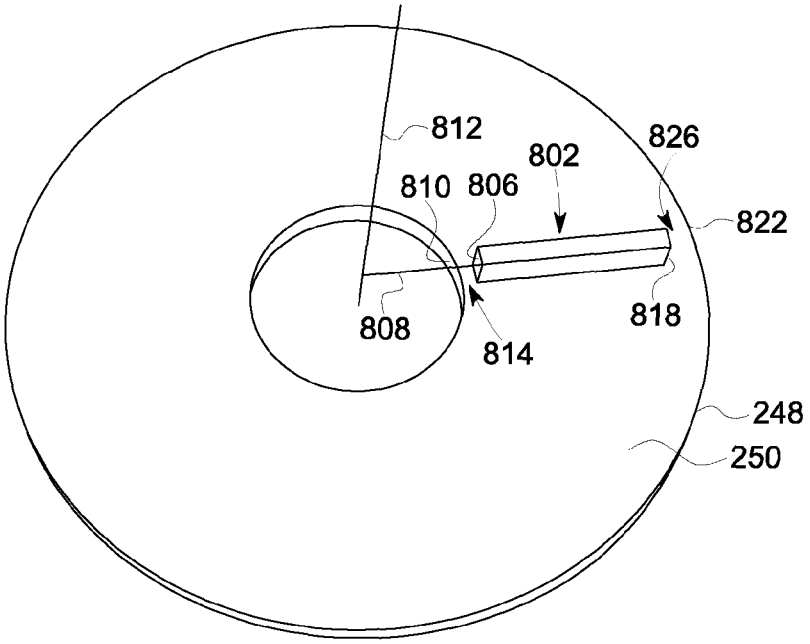
FIG. 8 shows a perspective view, approximately to scale, of an embodiment of a turbulence member installed on a gland plate of a fluid handling device.

FIG. 8 illustrates another non-limiting embodiment including a turbulence member that comprises an elongated, substantially rectangular block 802. An inner face 806 of the block 802 is spaced from an inner edge 810 of the gland plate 248 to define an inner channel 814 between the inner face and the seal assembly 206 (not shown). The inner face 806 may be oriented in a plane that is substantially perpendicular to an upper face 250 of the gland plate 248. A line 812 is shown extending axially through the center of the gland plate 248 and substantially perpendicular to the upper surface 250 of the gland plate. The plane of the inner face 806 may also be substantially perpendicular to a line 808 that extends radially from the line 812.

An outer face 818 of the block 802 is spaced from an outer edge 822 of the gland plate 248 to define an outer channel 826 between the outer face and the annular seal portion 234 of the housing 232 (not shown). Like the inner face 806, the outer face 818 may be oriented in a plane that is substantially perpendicular to the upper face 250 of the gland plate 248. The plane of the outer face 818 may also be substantially perpendicular to the line 808. Advantageously, this configuration of the turbulence member 802 on the gland plate 248 may provide flow disruption within the annular seal cavity 252 to provide prevention of air pocket formation adjacent to the seal assembly 206.

Figure 9:
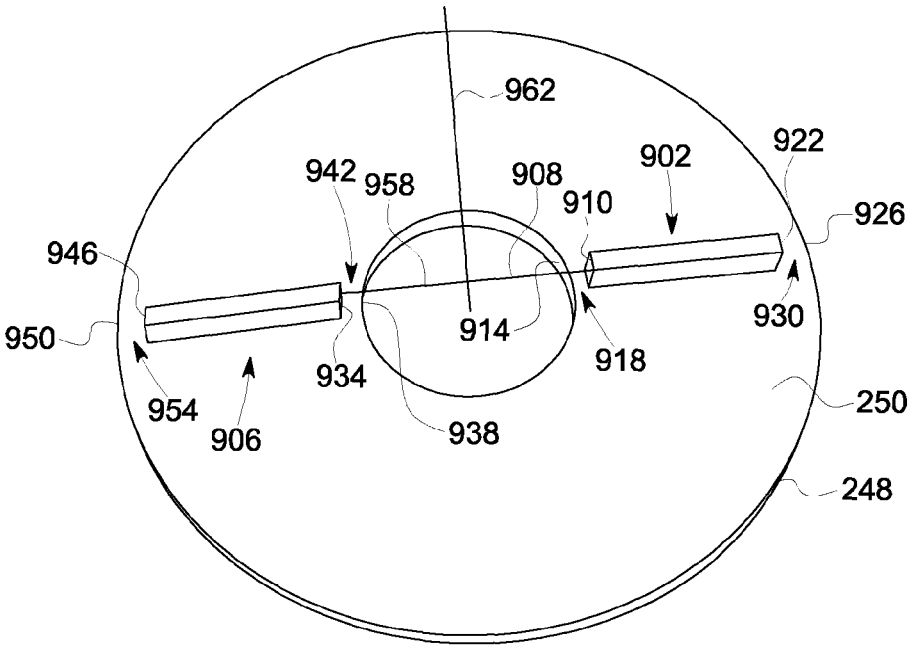
FIG. 9 shows a perspective view, approximately to scale, of an embodiment of two turbulence members installed on a gland plate of a fluid handling device.

FIG. 9 illustrates another non-limiting embodiment including a first turbulence member 902 and a second turbulence member 906 located on opposing sides of the gland plate 248. Each of the first turbulence member 902 and second turbulence member 906 has a construction and geometry similar to the elongated, substantially rectangular block 802 illustrated in FIG. 8. The first turbulence member 902 includes an inner face 910 that is spaced from an inner edge 914 of the gland plate 248 to define an inner channel 918 between the inner face and the seal assembly 206 (not shown). An outer face 922 of the first turbulence member 902 is spaced from an outer edge 926 of the gland plate 248 to define an outer channel 930 between the outer face and the annular seal portion 234 of the housing 232 (not shown).

Similarly, an inner face 934 of the second turbulence member 906 is spaced from an inner edge 938 of the gland plate 248 to define an inner channel 942 between the inner face and the seal assembly 206. An outer face 946 of the second turbulence member 902 is spaced from an outer edge 950 of the gland plate 248 to define an outer channel 954 between the outer face and the annular seal portion 234 of the housing 232. In one example, the two inner faces 910 and 934 may be oriented in planes that are substantially perpendicular to the upper face 250 of the gland plate 248. A line 962 is shown extending axially through the center of the gland plate 248 and substantially perpendicular to the upper surface 250 of the gland plate. The planes of the two inner faces 910 and 934 may also be substantially perpendicular to lines 908 and 958, respectively, that extend radially from the line 962.

Like the inner faces 910 and 934, the two outer faces 922 and 946 may be oriented in planes that are substantially perpendicular to the upper face 250 of the gland plate 248. The planes of the two outer faces 922 and 946 may also be substantially perpendicular to lines 908 and 958, respectively. Advantageously, this configuration of the first turbulence member 902 and the second turbulence member 906 on the gland plate 248 may provide flow disruption within the annular seal cavity 252 that prevents air pocket formation adjacent to the seal assembly 206. Additionally, by locating the first turbulence member 902 and second turbulence member 906 on opposing sides of the gland plate 248, this configuration may create substantially symmetrical turbulence in areas adjacent to the opposing sides. Advantageously, such symmetrical turbulence may balance corresponding loads imparted on the rotating impeller 228 by the circulating fluid.

Figure 10:
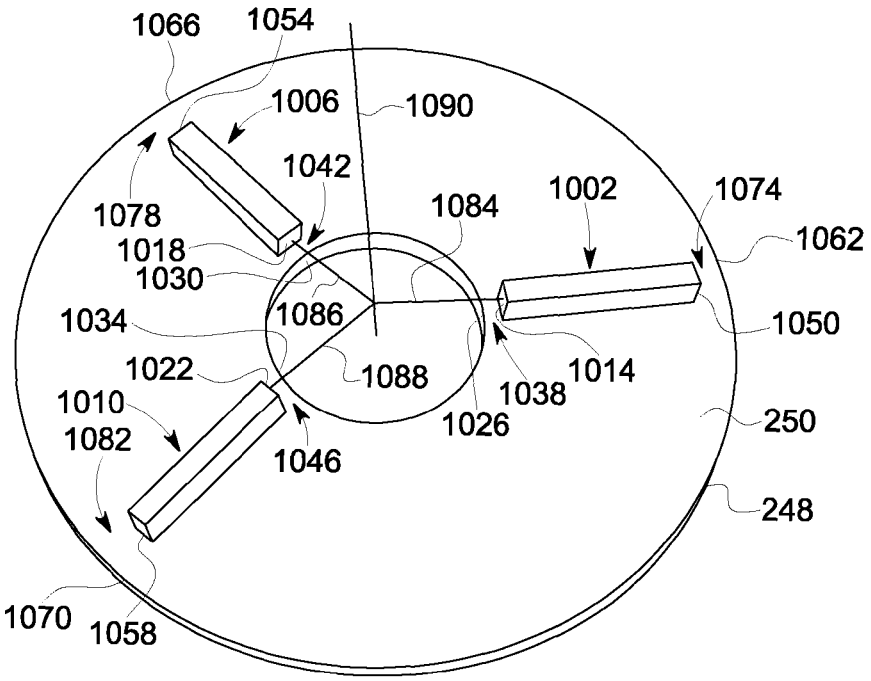
FIG. 10 shows a perspective view, approximately to scale, of an embodiment of three turbulence members installed on a gland plate of a fluid handling device.

FIG. 10 illustrates another non-limiting embodiment including a first turbulence member 1002, a second turbulence member 1006 and a third turbulence member 1010. In one example, the first turbulence member 1002, second turbulence member 1006 and third turbulence member 1010 may be equally spaced apart around the circumference of the gland plate 248. Alternatively expressed, the first turbulence member 1002, second turbulence member 1006 and third turbulence member 1010 may be spaced from one another at approximately 120 degree increments around the circumference of the gland plate 248. Each of the first turbulence member 1002, second turbulence member 1006 and third turbulence member 1010 may also have a construction and geometry similar to the elongated, substantially rectangular block 802 illustrated in FIG. 8.

In one example, each of the first turbulence member 1002, second turbulence member 1006 and third turbulence member 1010 may be oriented on the upper face 250 of the gland plate 248 in a manner similar to the rectangular block 802 illustrated in FIG. 8. More particularly, each of the first turbulence member 1002, second turbulence member 1006, and third turbulence member 1010 may include an inner face 1014, 1018, and 1022, respectively, that is spaced from a corresponding inner edge 1026, 1030, and 1034, respectively, of the gland plate 248 to define an inner channel 1038, 1042, and 1046, respectively, between the inner faces and the seal assembly 206. Similarly, each of the first turbulence member 1002, second turbulence member 1006, and third turbulence member 1010 may include an outer face 1050, 1054, and 1058, respectively, that is spaced from a corresponding outer edge 1062, 1066, and 1070, respectively, of the gland plate 248 to define an outer channel 1074, 1078, and 1082, respectively, between the outer faces and the annular seal portion 234 of the housing 232.

In one example, the three inner faces 1014, 1018, and 1022 may be oriented in planes that are substantially perpendicular to the upper face 250 of the gland plate 248. A line 1090 is shown extending axially through the center of the gland plate 248 and substantially perpendicular to the upper surface 250 of the gland plate. The planes of the three inner faces 1014, 1018, and 1022 may also be substantially perpendicular to lines 1084, 1086, and 1088, respectively, that extend radially from the line 1090.

Like the inner faces 1014, 1018, and 1022, the three outer faces 1050, 1054, and 1058 may be oriented in planes that are substantially perpendicular to the upper face 250 of the gland plate 248. The planes of the three outer faces 1050, 1054, and 1058 may also be substantially perpendicular to lines 1084, 1086, and 1088, respectively, that extend radially from line 1090. Advantageously, this configuration of first turbulence member 1002, second turbulence member 1006 and third turbulence member 1010 on the gland plate 248 may provide flow disruption within the annular seal cavity 252 that prevents air pocket formation adjacent to the seal assembly 206. Additionally, by equally spacing the first turbulence member 1002, second turbulence member 1006 and third turbulence member 1010 around the circumference of the gland plate 248, this configuration may create substantially symmetrical turbulence around the gland plate. Advantageously, such symmetrical turbulence may balance corresponding loads imparted on the rotating impeller 228 by the circulating fluid.

Figure 11:
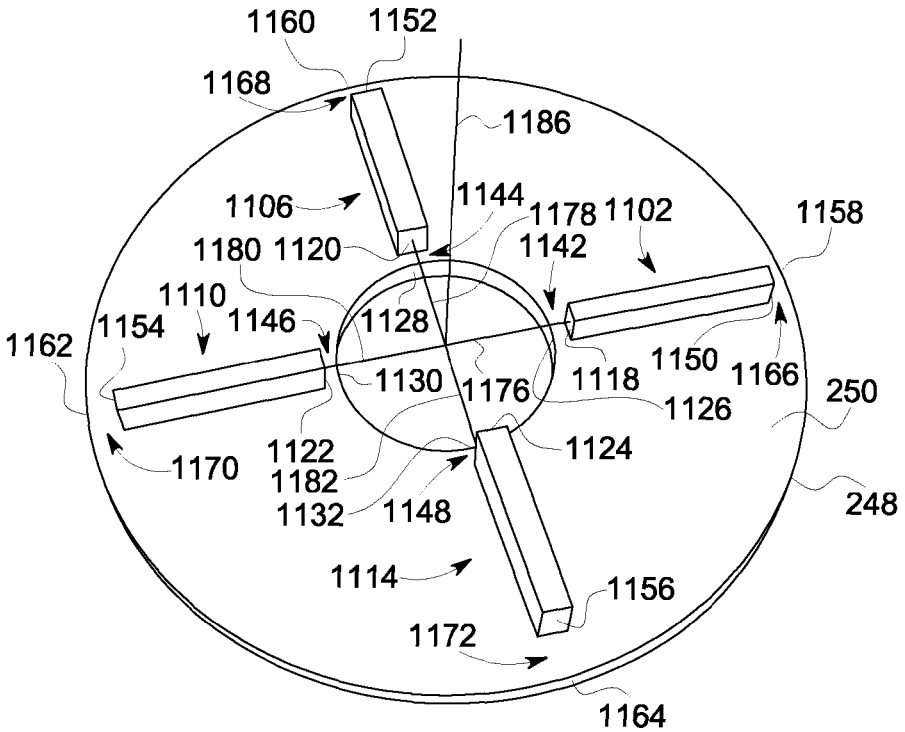
FIG. 11 shows a perspective view, approximately to scale, of an embodiment of four turbulence members installed on a gland plate of a fluid handling device.

FIG. 11 illustrates another non-limiting embodiment including a first turbulence member 1102, a second turbulence member 1106, a third turbulence member 1110, and a fourth turbulence member 1114. In one example, the first turbulence member 1102, second turbulence member 1106, third turbulence member 1110, and fourth turbulence member 1114 may be equally spaced apart around the circumference of the gland plate 248. Alternatively expressed, the first turbulence member 1102, second turbulence member 1106, third turbulence member 1110, and fourth turbulence member 1114 may be spaced from one another at approximately 90 degree increments around the circumference of the gland plate 248. Each of the first turbulence member 1102, second turbulence member 1106, third turbulence member 1110, and fourth turbulence member 1114 may also have a construction and geometry similar to the elongated, substantially rectangular block 802 illustrated in FIG. 8.

In one example, each of the first turbulence member 1102, second turbulence member 1106, third turbulence member 1110, and fourth turbulence member 1114 may be oriented on the upper face 250 of the gland plate 248 in a manner similar to the rectangular block 802 illustrated in FIG. 8. More particularly, each of the first turbulence member 1102, second turbulence member 1106, third turbulence member 1110, and fourth turbulence member 1114 may include an inner face 1118, 1120, 1122, and 1124, respectively, that is spaced from a corresponding inner edge 1126, 1128, 1130, and 1132, respectively, of the gland plate 248 to define an inner channel 1142, 1144, 1146, and 1148, respectively, between the inner faces and the seal assembly 206. Similarly, each of the first turbulence member 1102, second turbulence member 1106, third turbulence member 1110, and fourth turbulence member 1114 may include an outer face 1150, 1152, 1154, and 1156, respectively, that is spaced from a corresponding outer edge 1158, 1160, 1162, 1164, respectively, of the gland plate 248 to define an outer channel 1166, 1168, 1170, 1172, respectively, between the outer faces and the annular seal portion 234 of the housing 232.

In one example, the four inner faces 1118, 1120, 1122, and 1124 may be oriented in planes that are substantially perpendicular to the upper face 250 of the gland plate 248. A line 1186 is shown extending axially through the center of the gland plate 248 and substantially perpendicular to the upper surface 250 of the gland plate. The planes of the four inner faces 1118, 1120, 1122, and 1124 may also be substantially perpendicular to lines 1176, 1178, 1180, and 1182, respectively, that extend radially from the line 1186.

Like the inner faces 1118, 1120, 1122, and 1124, the four outer faces 1150, 1152, 1154, and 1156 may be oriented in planes that are substantially perpendicular to the upper face 250 of the gland plate 248. The planes of the four outer faces 1150, 1152, 1154, and 1156 may also be substantially perpendicular to lines 1176, 1178, 1180, and 1182, respectively. Advantageously, this configuration of first turbulence member 1102, second turbulence member 1106, third turbulence member 1110, and fourth turbulence member 1114 on the gland plate 248 may provide flow disruption within the annular seal cavity 252 that prevents air pocket formation adjacent to the seal assembly 206. Additionally, by equally spacing the first turbulence member 1102, second turbulence member 1106, third turbulence member 1110, and fourth turbulence member 1114 around the circumference of the gland plate 248, this configuration may create substantially symmetrical turbulence around the gland plate. Advantageously, such symmetrical turbulence may balance corresponding loads imparted on the rotating impeller 228 by the circulating fluid.

Figure 12:
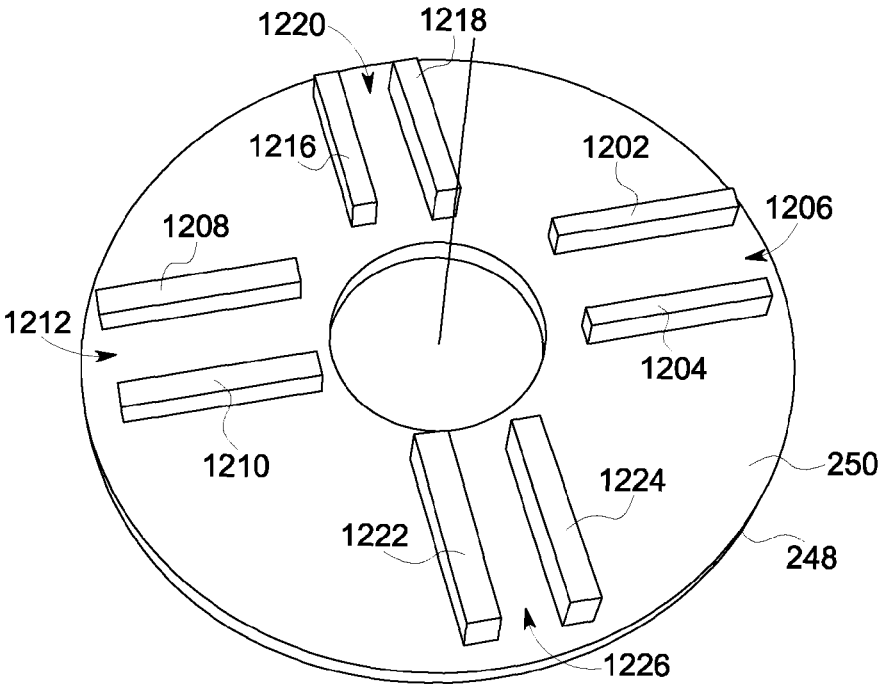
FIG. 12 shows a perspective view, approximately to scale, of an embodiment of four pairs of turbulence members installed on a gland plate of a fluid handling device.

FIG. 12 illustrates another non-limiting embodiment including four pairs of turbulence members. In one example, a first pair of turbulence members includes a first turbulence member 1202 and a second turbulence member 1204 that are arranged substantially parallel to one another to define a gap 1206 there between. The first turbulence member 1202 may be radially aligned with a third turbulence member 1208 located on an opposing side of the gland plate 248. The second turbulence member 1204 may be radially aligned with a fourth turbulence member 1210 located on an opposing side of the gland plate 248. The third turbulence member 1208 and fourth turbulence member 1210 comprise a second pair of turbulence members, and are arranged substantially parallel to one another to define a gap 1212 there between.

Similarly, a third pair of turbulence members includes a fifth turbulence member 1216 and a sixth turbulence member 1218 that are arranged substantially parallel to one another to define a gap 1220 there between. The fifth turbulence member 1216 may be radially aligned with a seventh turbulence member 1222 located on an opposing side of the gland plate 248. The sixth turbulence member 1218 may be radially aligned with an eighth turbulence member 1224 located on an opposing side of the gland plate 248. The seventh turbulence member 1222 and eighth turbulence member 1224 comprise a fourth pair of turbulence members, and are arranged substantially parallel to one another to define a gap 1226 there between. Each of the first turbulence member 1202, second turbulence member 1204, third turbulence member 1208, fourth turbulence member 1210, fifth turbulence member 1216, sixth turbulence member 1218, seventh turbulence member 1222 and eight turbulence member 1224 may also have a construction and geometry similar to the elongated, substantially rectangular block 802 illustrated in FIG. 8. Advantageously, this configuration of four pairs of turbulence members on the gland plate 248 may provide flow disruption within the annular seal cavity 252 that prevents air pocket formation adjacent to the seal assembly 206. Additionally, the gap between each pair of turbulence members may provide enhanced turbulence in the annular seal cavity 252 for applications and configurations benefiting from a greater amount of flow disruption.

Figure 13:
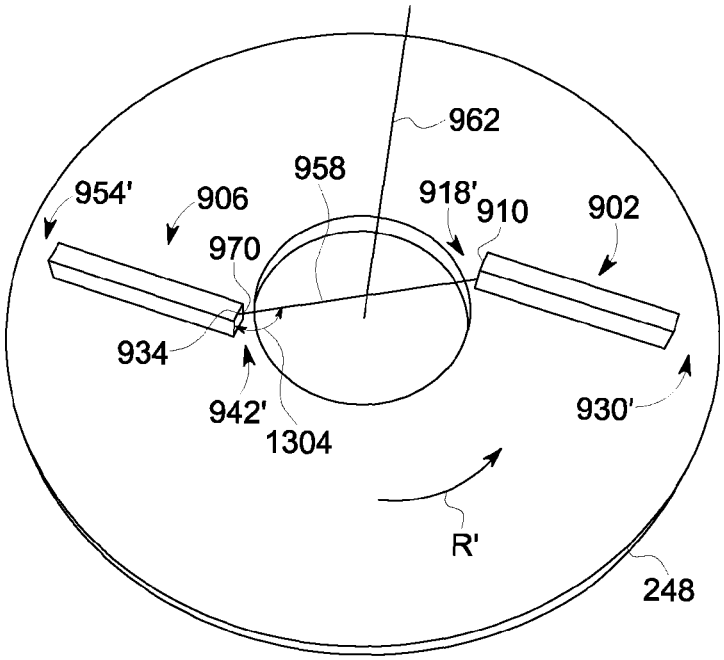
FIG. 13 shows a perspective view, approximately to scale, of an embodiment of two turbulence members installed on a gland plate of a fluid handling device.

FIG. 13 illustrates another non-limiting embodiment that includes the first turbulence member 902 and second turbulence member 906 shown in FIG. 9 and described above. In this embodiment, the first turbulence member 902 and second turbulence member 906 are angled with respect to the center of the gland plate 248. In one example, the inner face 934 of the second turbulence member 906 is oriented in a plane that forms an oblique angle 1304 with respect to the line 958 that extends radially from line 962. In this example, the line 958 intersects the right edge 970 of the second turbulence member 906. The angle 1304 may be in the range between approximately 91 degrees and 179 degrees, and more specifically between approximately 100 degrees and 169 degrees, and even more specifically between approximately 110 and 159 degrees, and even more specifically approximately 135 degrees. Additionally, with respect to this non-limiting embodiment, during operation of the pump 204 the impeller 228 may rotate in the counter-clockwise direction of action arrow R', which correspondingly creates a fluid flow direction within the annular seal cavity 252 in the counter-clockwise direction of R'. Advantageously, the angled configuration of first turbulence member 902 and second turbulence member 906 directs the fluid flow toward the seal assembly 206 to thereby inhibit air pocket formation adjacent to the seal assembly.

With continued reference to FIG. 13, the inner face 934 may define a variable depth inner channel 942' between the inner face and the seal assembly 206. In a similar manner, the inner face 910 of the first turbulence member 902 may define a variable depth channel 918' between the inner face 910 and the seal assembly 206. It will also be appreciated that outer channels 930' and 954' may have a variable depth with respect to the outer circumference of the gland plate 248 adjacent to each outer channel. Additionally, the outer channels 930' and 954' may have a variable depth greater than the variable depth of the corresponding inner channels 918' and 942', respectively. Advantageously, this configuration of the first turbulence member 902 and the second turbulence member 906 on the gland plate 248 may create flow disruption patterns within the annular seal cavity 252 that provide improved prevention of air pocket formation adjacent to the seal assembly 206 for certain applications and configurations of seal assemblies and corresponding fluid handling devices.

Figure 14:
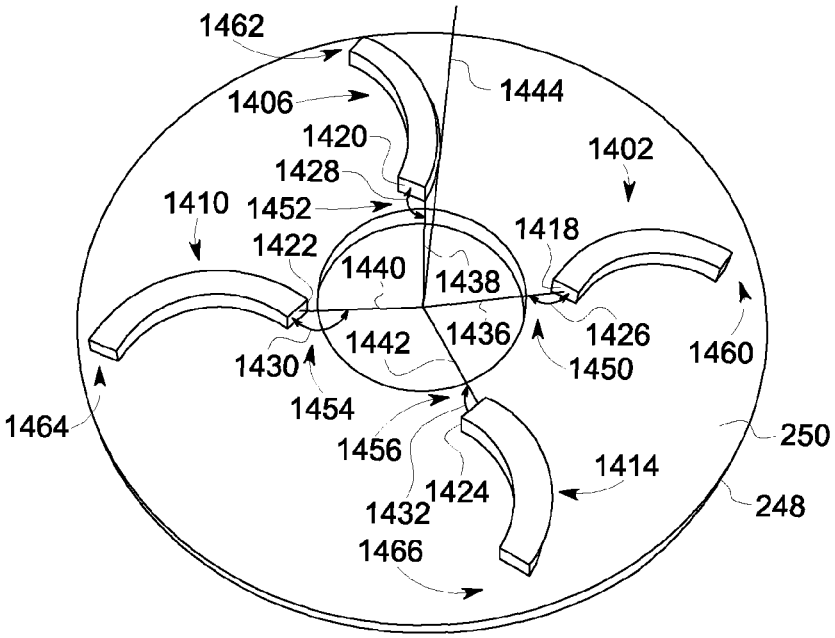
FIG. 14 shows a perspective view, approximately to scale, of an embodiment of four turbulence members installed on a gland plate of a fluid handling device.

FIG. 14 illustrates another non-limiting embodiment including a first turbulence member 1402, a second turbulence member 1406, a third turbulence member 1410, and a fourth turbulence member 1414. In one example, the first turbulence member 1402, second turbulence member 1406, third turbulence member 1410, and fourth turbulence member 1414 may be equally spaced apart around the circumference of the gland plate 248. Alternatively expressed, the first turbulence member 1402, second turbulence member 1406, third turbulence member 1410, and fourth turbulence member 1414 may be spaced from one another at approximately 90 degree increments around the circumference of the gland plate 248.

Each of the first turbulence member 1402, second turbulence member 1406, third turbulence member 1410, and fourth turbulence member 1414 may have an arcuately extending shape with a rectangular cross section. In one example as shown in FIG. 14, the first turbulence member 1402 and third turbulence member 1410 are located on an opposing side of the gland plate 248 and have curvatures directed in opposing directions with respect to the upper face 250 of the gland plate. Alternatively expressed, the first turbulence member 1402 may have a convex shape with a leading edge directed in a counter-clockwise direction around the gland plate 248, while the third turbulence member 1410 may have a convex shape with a leading edge directed in a clockwise direction around the gland plate. In a similar manner, the second turbulence member 1406 may have a convex shape with a leading edge directed in a clockwise direction around the gland plate 248, while the fourth turbulence member 1414 may have a convex shape with a leading edge directed in a counter-clockwise direction around the gland plate.

In one example, each of the first turbulence member 1402, second turbulence member 1406, third turbulence member 1410, and fourth turbulence member 1414 may include an inner rectangular face 1418, 1420, 1422, and 1424, respectively. A line 1444 may extend axially through the center of the gland plate 248 and substantially perpendicular to the upper surface 250 of the gland plate. Each of the inner rectangular faces 1418, 1420, 1422, and 1424 may be oriented in a plane that forms an oblique angle 1426, 1428, 1430, and 1432, respectively, with respect to lines 1436, 1438, 1440, and 1442, respectively, that extend radially from the line 1444. Each of the angles 1426, 1428, 1430, and 1432 may be in the range between approximately 91 degrees and 179 degrees, and more specifically between approximately 100 degrees and 169 degrees, and even more specifically between approximately 110 and 159 degrees, and even more specifically approximately 135 degrees.

With continued reference to FIG. 14, each of the inner faces 1418, 1420, 1422, and 1424 may define a variable depth inner channel 1450, 1452, 1454, and 1456, respectively, between the inner face and the seal assembly 206. It will also be appreciated that outer channels 1460, 1462, 1464, and 1466 may have a variable depth with respect to the outer circumference of the gland plate 248 adjacent to each outer channel. Advantageously, this configuration of first turbulence member 1402, second turbulence member 1406, third turbulence member 1410, and fourth turbulence member 1414 on the gland plate 248 may create flow disruption patterns within the annular seal cavity 252 that provide improved prevention of air pocket formation adjacent to the seal assembly 206 for certain applications and configurations of seal assemblies and corresponding fluid handling devices.

Figure 15:
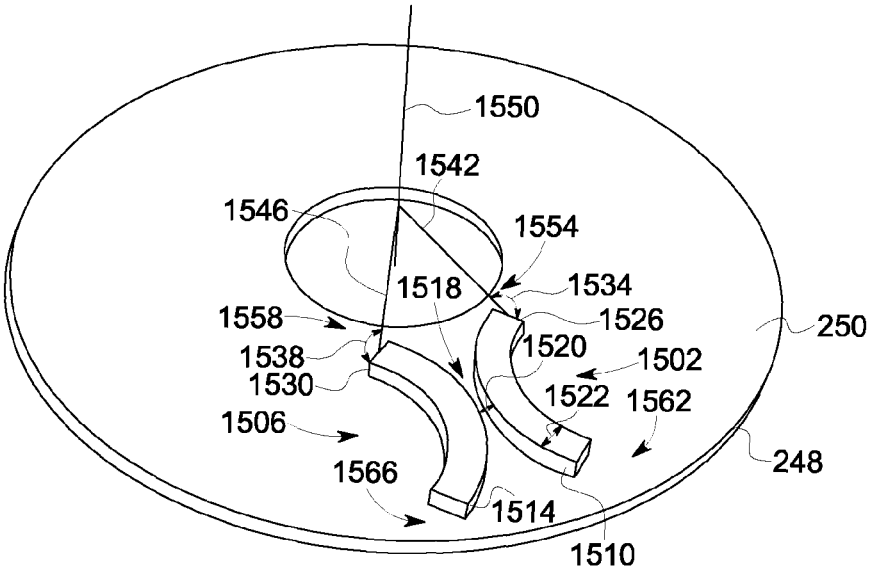
FIG. 15 shows a perspective view, approximately to scale, of an embodiment of two turbulence members installed on a gland plate of a fluid handling device.

FIG. 15 illustrates another non-limiting embodiment including a first turbulence member 1502 and a second turbulence member 1506 that each have an arcuately extending shape with a rectangular cross section. In one example, the first turbulence member 1502 and second turbulence member 1506 may have curvatures directed in opposing directions with respect to the upper face 250 of the gland plate. Alternatively expressed, the first turbulence member 1502 may have a convex shape with a leading side 1510 directed in a clockwise direction around the gland plate 248, while the second turbulence member 1506 may have a convex shape with a leading side 1514 directed in a counter-clockwise direction around the gland plate. Additionally, at least a portion of the leading side 1510 of the first turbulence member 1502 may face at least a portion of the leading side 1514 of the second turbulence member 1506 to form a passage 1518 there between. In one example, a narrow portion of the passage 1518 may have a passage width 1520 that is less than a turbulence member width 1522 of the first turbulence member 1502.

In one example, the first turbulence member 1502 and second turbulence member 1506 may each include an inner face 1526 and 1530, respectively. A line 1550 is shown extending axially through the center of the gland plate 248 and substantially perpendicular to the upper surface 250 of the gland plate. Inner faces 1526 and 1530 are each oriented in a plane that forms an oblique angle 1534 and 1538, respectively, with respect to lines 1542 and 1546, respectively, that extend radially from line 1550. Each of the angles 1534 and 1538 may be in the range between approximately 91 degrees and 179 degrees, and more specifically between approximately 100 degrees and 169 degrees, and even more specifically between approximately 110 and 159 degrees, and even more specifically approximately 135 degrees.

With continued reference to FIG. 15, each of the inner faces 1526 and 1530 may define a variable depth inner channel 1554 and 1558, respectively, between the inner face and the seal assembly 206. It will also be appreciated that outer channels 1562 and 1566 may have a variable depth with respect to the outer circumference of the gland plate 248 adjacent to each outer channel. Advantageously, this configuration of first turbulence member 1502 and second turbulence member 1506 on the gland plate 248 may create flow disruption patterns within the annular seal cavity 252 that provide improved prevention of air pocket formation adjacent to the seal assembly 206 for certain applications and configurations of seal assemblies and corresponding fluid handling devices.

Figure 16:
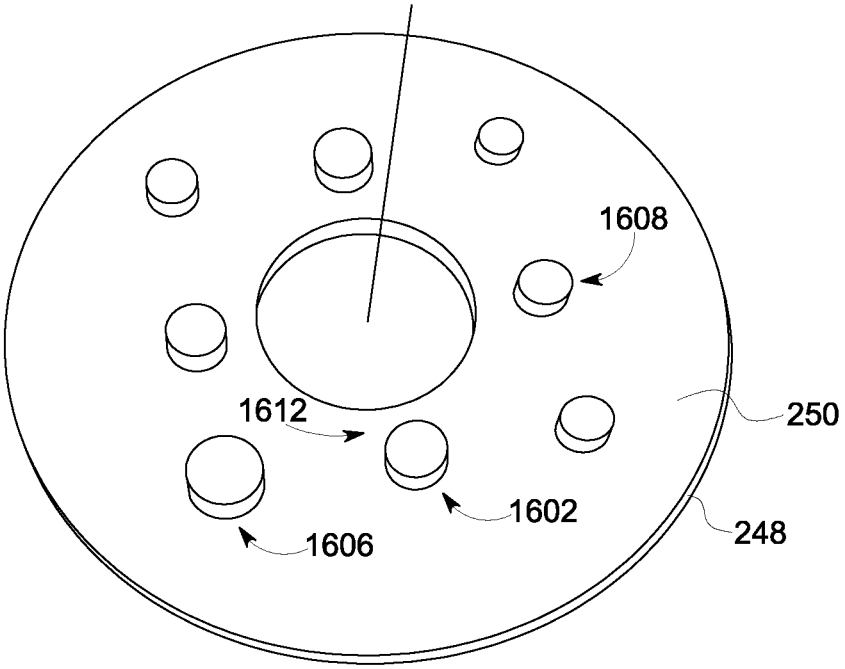
FIG. 16 shows a perspective view, approximately to scale, of an embodiment of eight turbulence members installed on a gland plate of a fluid handling device.

FIG. 16 illustrates another non-limiting embodiment including a plurality of disc-shaped turbulence members, such as turbulence members 1602, 1606, and 1608, located on the upper face 250 of the gland plate 248. As shown in FIG. 16, in one example the plurality of disc-shaped turbulence members may have different diameters. In other examples, one or more of the plurality of disc-shaped turbulence members may have the same diameter. At least one of the disc-shaped turbulence members, such as turbulence member 1602, may define a variable depth inner channel, such as channel 1612, between the turbulence member and the seal assembly 206. In some examples, additional turbulence members may also define variable with channels between the turbulence member and the seal assembly 206. Advantageously, this configuration of multiple disc-shaped turbulence members on the gland plate 248 may create flow disruption patterns within the annular seal cavity 252 that provide improved prevention of air pocket formation adjacent to the seal assembly 206 for certain applications and configurations of seal assemblies and corresponding fluid handling devices.

Another embodiment relates to a turbulence member for an annular seal cavity in a fluid handling device. The turbulence member comprises a turbulence member body (e.g., a solid made of metal, polymer, and/or one or more other materials) positioned to cooperate with a seal assembly in the annular seal cavity to define an inner channel between the inner face and the seal assembly. The turbulence member body is further positioned to cooperate with a housing to define an outer channel in the annular seal cavity. The turbulence member is operable to disrupt fluid flow within the annular seal cavity to inhibit formation of an air pocket adjacent to the seal assembly. The turbulence member body may be shaped as described elsewhere herein (e.g., FIGS. 3, 8, 13, 14, 16, and so on).

Another embodiment relates to a seal protection system for a fluid handling device. The system comprises a seal assembly, a shaft that extends through the seal assembly, an impeller mounted on the shaft, and a gland plate in surrounding relationship to the shaft. The gland plate, the impeller, the seal assembly, and a housing cooperate to form an annular seal cavity. The system further comprises a turbulence member positioned within the annular seal cavity and coupled to the gland plate. The turbulence member comprises a turbulence member body positioned adjacent to the seal assembly and positioned to cooperate with the seal assembly to define an inner channel between the inner face and the seal assembly. The turbulence member body is further positioned adjacent to the housing (i.e., a portion of the body extends from adjacent to the seal assembly to adjacent to the housing) and is positioned to cooperate with the housing to define an outer channel in the annular seal cavity. The turbulence member is operable to disrupt fluid flow within the annular seal cavity to inhibit formation of an air pocket adjacent to the seal assembly. The turbulence member body may be shaped as described elsewhere herein (e.g., FIGS. 3, 8, 13, 14, 16, and so on).

Another embodiment relates to a seal protection system for a fluid handling device. The fluid handling device has a housing, a seal assembly, and a seal cavity, and may or may not additionally include other features as described elsewhere herein, e.g., a shaft that extends through the seal assembly, an impeller mounted on the shaft, and a gland plate in surrounding relationship to the shaft. The seal protection system comprises one or more turbulence members positioned within the seal cavity (e.g., coupled to the gland plate or otherwise). The one or more turbulence members are operable to disrupt fluid flow within the seal cavity to inhibit formation of an air pocket adjacent to the seal assembly. In one embodiment, the turbulence member is a wedge-shaped block having arcuate inner and outer faces (FIG. 3 and related description are applicable). In one embodiment, there are two or more spaced-apart turbulence members, each being a wedge-shaped block having arcuate inner and outer faces (FIG. 3 and related description are applicable). In another embodiment, the turbulence member is a rectangular solid (FIG. 8 and related description are applicable). In another embodiment, there are two or more spaced-apart turbulence members, each being a rectangular solid (FIGS. 8-13 and related description are applicable). In another embodiment, the turbulence member has an arcuately extending shape with a rectangular cross section (FIGS. 14-15 and related description are applicable). In another embodiment, there are two or more spaced-apart turbulence members, each having an arcuately extending shape with a rectangular cross section (FIGS. 14-15 and related description are applicable). In another embodiment, the turbulence member is a cylindrical solid (FIG. 16 and related description are applicable). In another embodiment, there are two or more spaced-apart turbulence members, each being a cylindrical solid (FIG. 16 and related description are applicable). In another embodiment, there are two or more spaced-apart turbulence members, which are shaped differently from one another (e.g., rectangular solid, cylindrical solid, wedge-shaped, and/or acuately-extending with rectangular cross-section).

Certain features or other aspects of the invention are described herein as being annular. This may refer to the feature being strictly ring-shaped, at least generally or somewhat ring-shaped, and/or it may refer to the feature circumscribing (e.g., circularly circumscribing) another feature.

In this written description, references to "one embodiment" or "an embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbulence member for an annular seal cavity in a fluid handling device, the turbulence member comprising:

an inner face having an at least partially concave arcuate profile and positioned to cooperate with a seal assembly in the annular seal cavity to define an inner channel between the inner face and the seal assembly;

an outer face having an arcuate profile and positioned to cooperate with a housing to define an outer channel providing a flow path in the annular seal cavity between the outer face and the housing;

a front face extending between the inner face and the outer face; and a rear face spaced from the front face and extending between the inner face and the outer face, wherein the turbulence member is operable to disrupt fluid flow within the annular seal cavity to inhibit formation of an air pocket adjacent to the seal assembly.

2. The turbulence member of claim 1, wherein the fluid handling device includes a rotatable member coupled to a shaft that extends through the seal assembly, the seal assembly including a first end adjacent to a gland plate and a second opposing end adjacent to the rotatable member, wherein the turbulence member is coupled to the gland plate.

3. The turbulence member of claim 2, wherein the turbulence member is removably coupled to the gland plate, and wherein the turbulence member is a wedge-shaped block having arcuate inner and outer faces.

4. The turbulence member of claim 3, wherein the turbulence member includes a first aperture and the gland plate includes a second aperture, and a fastener extends through the first aperture and the second aperture to removably couple the turbulence member to the gland plate.

5. The turbulence member of claim 2, wherein the seal assembly includes a retainer part having an outer face that defines a working height of the seal assembly, and the inner face of the turbulence member extends axially from the gland plate to a distance that is less than the working height.

6. The turbulence member of claim 1, wherein the inner channel has an inner channel variable depth and the outer channel has an outer channel variable depth.

7. The turbulence member of claim 1, wherein the turbulence member comprises a block having a top surface and an opposing parallel bottom surface, and wherein the inner face, the outer face, the front face and the rear face each extend between the top surface and the bottom surface.

8. The turbulence member of claim 7, wherein a first area of the top surface of the block is no greater than 12.5% of a second area of the annular seal cavity.

9. A system comprising:

the turbulence member of claim 1, wherein the turbulence member is a first turbulence member, and the inner channel is a first inner channel having a first inner diameter and a first outer diameter; and a second turbulence member spaced from the first turbulence member, the second turbulence member positioned to cooperate with the seal assembly to define a second inner channel, the second inner channel having a second inner diameter substantially equal to the first inner diameter, and having a second outer diameter substantially equal to the first outer diameter.

10. A seal protection system for a fluid handling device, comprising:

a seal assembly, a shaft that extends through the seal assembly, an impeller mounted on the shaft, and a gland plate in surrounding relationship to the shaft, wherein the gland plate, the impeller, the seal assembly, and a housing cooperate to form an annular seal cavity; and a turbulence member positioned within the annular seal cavity and coupled to the gland plate, the turbulence member comprising:

an inner face having an at least partially concave arcuate profile adjacent to the seal assembly and positioned to cooperate with the seal assembly to define an inner channel between the inner face and the seal assembly;

an outer face having an arcuate profile adjacent to the housing and positioned to cooperate with the housing to define an outer channel in the annular seal cavity;

a front face extending between the inner face and the outer face; and a rear face spaced from the front face and extending between the inner face and the outer face, wherein the turbulence member is operable to disrupt fluid flow within the annular seal cavity to inhibit formation of an air pocket adjacent to the seal assembly.

11. The seal protection system of claim 10, wherein the turbulence member is removably coupled to the gland plate, and wherein the turbulence member is wedge-shaped.

12. The seal protection system of claim 11, wherein the turbulence member includes a first aperture and the gland plate includes a second aperture, and a fastener extends through the first aperture and the second aperture to removably couple the turbulence member to the gland plate.

13. The seal protection system of claim 10, wherein the turbulence member is a first turbulence member, further comprising a second turbulence member spaced from the first turbulence member, the second turbulence member positioned within the annular seal cavity and coupled to the gland plate.

14. The seal protection system of claim 10, wherein the seal assembly includes a retainer part having an outer face that defines a working height of the seal assembly, and the inner face of the turbulence member extends axially from the gland plate to a distance that is less than the working height.

15. The seal protection system of claim 10, wherein the inner channel has an inner channel variable depth and the outer channel has an outer channel variable depth.

16. A water pump for an engine cooling system in an internal combustion engine, the water pump comprising:

an inlet having a central axis;

an outlet fluidically coupled to the inlet;

a shaft rotatably disposed downstream from the inlet and parallel to the central axis;

an impeller coupled to the shaft;

a seal assembly in surrounding relationship to the shaft, the seal assembly including a first end adjacent to a gland plate and a second opposing end adjacent to the impeller; and a turbulence member coupled to the gland plate and extending from the gland plate into an annular seal cavity, the turbulence member comprising:

an inner face positioned to cooperate with the seal assembly in the annular seal cavity to define an inner channel between the inner face and the seal assembly, the inner face having an at least partially concave arcuate profile to create a corresponding arcuate profile in the inner channel; and an outer face positioned to cooperate with a housing to define an outer channel in the annular seal cavity, the outer face having an arcuate profile to create a corresponding arcuate profile in the outer channel, wherein the turbulence member is operable to disrupt fluid flow within the annular seal cavity to inhibit formation of an air pocket adjacent to the seal assembly.

17. The water pump of claim 16, wherein the turbulence member is removably coupled to the gland plate.

18. The water pump of claim 16, wherein the inner channel has an inner channel variable depth and the outer channel has an outer channel variable depth.

19. The water pump of claim 16, wherein the turbulence member is a first turbulence member, the inner channel is a first inner channel having a first inner diameter and a first outer diameter, and the water pump further comprises a second turbulence member spaced from the first turbulence member, the second turbulence member positioned to cooperate with the seal assembly to define a second inner channel, the second inner channel having a second inner diameter substantially equal to the first inner diameter, and having a second outer diameter substantially equal to the first outer diameter.

* * * * *